US005373791A

United States Patent [19]

Bach et al.

[11] Patent Number: 5,373,791

[45] Date of Patent: Dec. 20, 1994

[54] TOY WHEEL

[75] Inventors: Erik Bach; Kaj S. Mikkelsen, both of Billund, Denmark

[73] Assignee: Interlego A.G., Baar, Switzerland

[21] Appl. No.: 70,405

[22] PCT Filed: Dec. 3, 1991

[86] PCT No.: PCT/DK91/00375

§ 371 Date: Jun. 29, 1993

§ 102(e) Date: Jun. 29, 1993

[87] PCT Pub. No.: WO92/10259

PCT Pub. Date: Jun. 25, 1992

[30] Foreign Application Priority Data

Dec. 4, 1990 [DK] Denmark ..... 2877/90

[51] Int. Cl.[5] ..... A63H 19/00

[52] U.S. Cl. ..... 104/288; 191/45 R; 295/9.1; 295/43; 246/255

[58] Field of Search ..... 104/288, 305, 306, 295; 105/49, 26.05; 246/255; 191/45; 295/1, 9.1, 43

[56] References Cited

U.S. PATENT DOCUMENTS

| | | | |
|---|---|---|---|
| 717,340 | 12/1902 | Cadmus | 295/9.1 |
| 1,754,995 | 4/1930 | Galligan | 295/9.1 |
| 1,830,879 | 11/1931 | Michelin | 295/9.1 |
| 2,079,525 | 5/1937 | Place | 246/255 |
| 2,462,073 | 2/1949 | Daughton | 246/255 |
| 2,687,304 | 8/1954 | Northrop et al. | 104/295 |
| 4,665,833 | 5/1987 | Fleishman et al. | 295/1 |

FOREIGN PATENT DOCUMENTS

| | | | |
|---|---|---|---|
| 0725214 | 2/1932 | France | 246/255 |
| 3133560 | 3/1983 | Germany . | |
| 3300072 | 7/1984 | Germany . | |
| 0053751 | 2/1923 | Sweden | 295/9.1 |
| 2176124 | 12/1986 | United Kingdom . | |

*Primary Examiner*—Mark T. Le

*Attorney, Agent, or Firm*—Kane, Dalsimer, Sullivan, Kurucz, Levy, Eisele and Richard

[57] ABSTRACT

A toy wheel for a model electric train is provided which is formed of two parts axially arranged next to each other. One part of the wheel has a rolling face having a high coefficient of friction for engagement with a track rail. The other part of the wheel is electrically conducting and, in use, engages a side of the track rail. A spring biases the electrically conducting part toward the rolling part and, in use, into electrical engagement with the current carrying rail on which the rolling part rides.

8 Claims, 2 Drawing Sheets

TOY WHEEL

Figure 1:
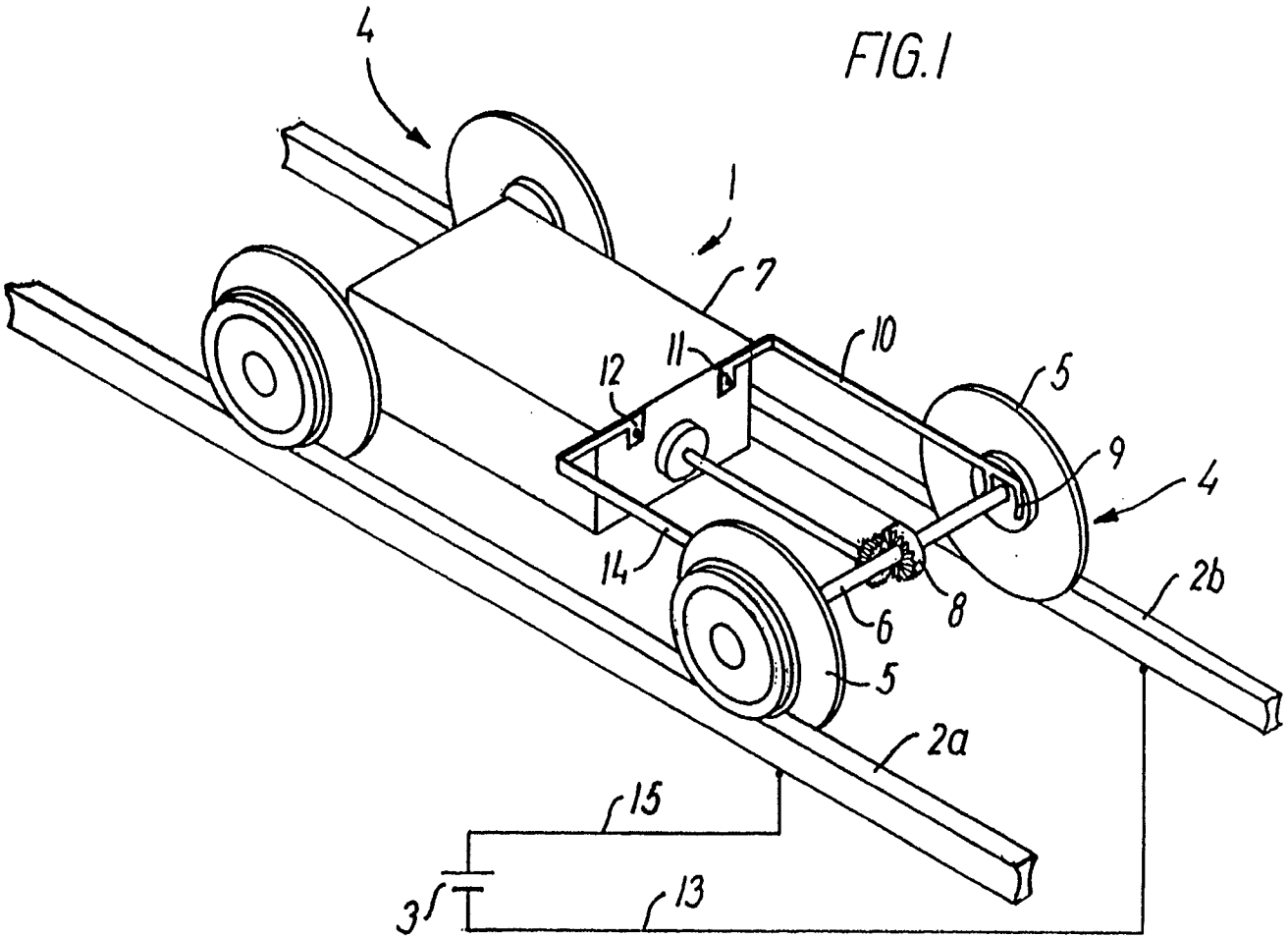

The invention concerns a toy wheel, which is preferably intended for an electrical toy or model train where the wheel can collect electrical current from an electrically conducting rail.

In electrically driven toy or model trains it is a problem to obtain good electrical contact between rail and wheel and also a high fraction between rail and wheel. The electrical contact is necessary to ensure continuous operation of the train, and the high friction is necessary to obtain a reasonably high tractive force for the train.

It has previously been proposed to solve the problem by equipping the train with special drive wheels having the necessary friction while other wheels ensure the electrical connection with the rail body. Such a structure is known e.g. from GB 2 176 124 A. The friction on the special drive wheels is usually obtained by providing the metal wheel with a groove in which a so-called adherence ring of elastic material, e.g. rubber, is embedded. This solution has the drawback that owing to short, dead sections on the rail body, the train must necessarily have at least two sets of electrically conducting wheels, which together with the drive wheels results in a total of three sets of wheels.

DE 31 33 560 discloses wheels where the adherence rings are made of a conducting, elastic material; but the conductivity of such materials is considerably inferior to that of metal so that sufficiently good electrical contact between rail and wheel cannot be obtained.

DE 33 00 072 provides wheels which are coated with a conducting layer of high friction, e.g. a layer of hard metal dust or diamond particles. The drawback of this solution is both that it is a cumbersome process to apply the coating, and that the friction obtained is still considerably inferior to the one obtainable with traditional adherence rings.

Current transmission by means of the rolling face of the wheels moreover has the general drawback that it causes spark formation and radio noise owing to obliquities, irregularities and the like, which result in unstable contact. Further, the .spark formation per se involves dirtying of both rails and wheels, which gradually makes the problem worse.

The invention provides a wheel which enables good electrical contact while having a high friction. The wheel moreover has a self-cleaning effect, so that dirtying of rails and wheels is prevented.

This is achieved according to the invention in that the wheel comprises a carrying par% with a rolling face and an electrically conducting part arranged axially at one side of the rolling face. The electrically conducting part extends radially outside the rolling face and is elastically movable and spring-loaded in a direction toward the rolling face. When the electrically conducting part is made elastically movable and spring-loaded, as mentioned, certain current collection will be obtained because this part is constantly pressed against the conductor rail, and also a self-cleaning effect preventing dirtying of wheel and rail.

When, as described in claim 2, the rolling face of the wheel is given a surface with a high coefficient of friction, high tractive force of the train is obtained in addition to the certain current collection.

The electrically conducting part may expediently be formed as a cone-shaped flange, as mentioned in claim 3. This entails that the wheel has a great resemblance to a normal railway wheel.

As stated in claim 4, the spring-loading may be established by providing one or more spring bodies on a bracket which are adapted to press the electrically conducting part resiliently against the carrying part. This is particularly advantageous when the said spring bodies are moreover incorporated in an electrical current path from the electrically conducting part to the current consumers of the train, e.g. a motor, as stated in claim 5.

As stated in claim 6, the carrying part and the electrically conducting part may be retained against mutual rotation.

This may take place, as stated in claim 7, in that the carrying part has holding pins adapted to engage corresponding openings in the electrically conducting part. The electrically conducting part is supported hereby and also has a certain movability with respect to the carrying part.

In an alternative embodiment, which is mentioned in claim 8, the electrically conducting part may rotate about its axis independently of the rolling face. This provides an improvement of the self-cleaning effect in certain situations.

Figure 2:
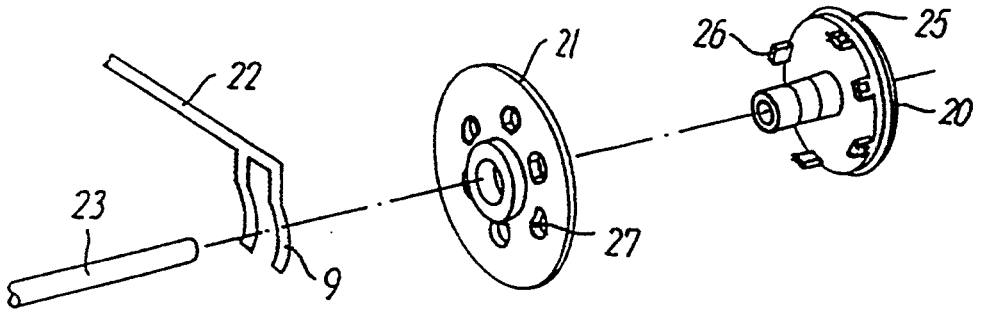
Figure 3:
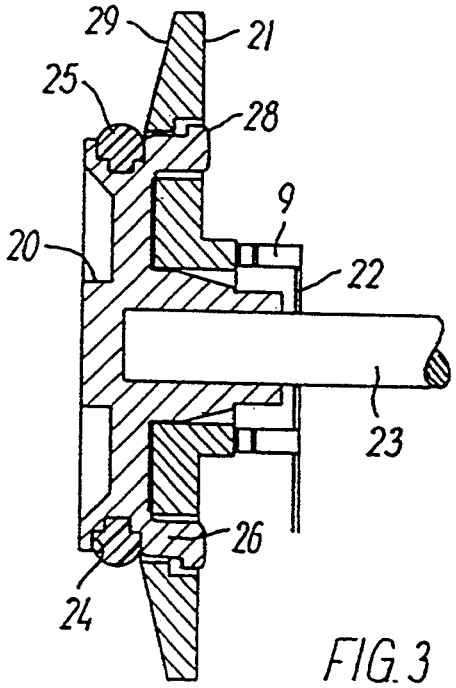
Figure 4:
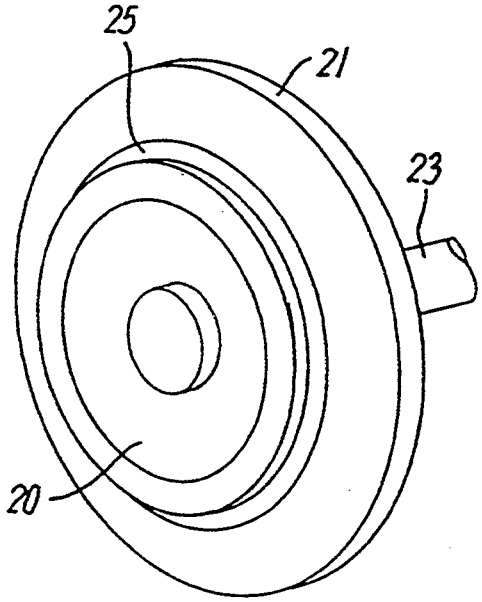
Figure 6:
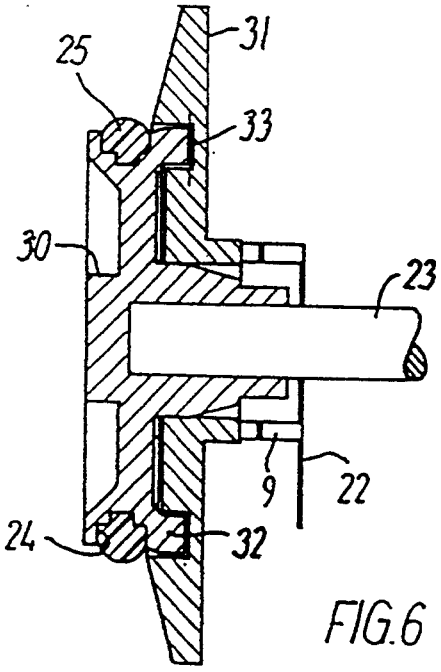
Figure 5:
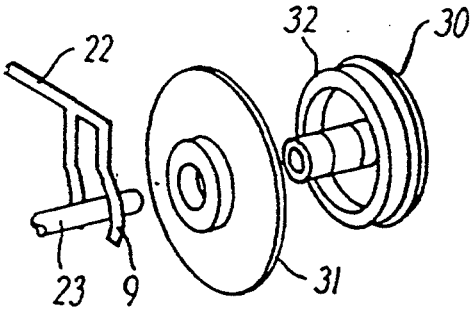

The invention will be described more fully below with reference to the drawing, in which FIG. 1 shows the use of a wheel according to the invention for a vehicle, FIG. 2 is a perspective view of components for a wheel according to the invention, FIG. 3 is a vertical section through the wheel of FIG. 2, FIG. 4 is a perspective view of the wheel of FIG. 2, FIG. 5 shows components for an alternative embodiment, and FIG. 6 is a vertical section through the wheel of FIG. 5.

FIG. 1 shows the technical principles of a vehicle for a toy or model train where a wheel according to the invention may be used. The vehicle may run on rails *2a*, *2b* to which an electrical voltage may be coupled, e.g. from a battery 3. As shown in FIG. 1, the vehicle 1 may e.g. have two sets 4 of wheels, consisting of two wheels 5 on a shaft 6. Both wheel sets 4 may be adapted to collect electrical current from the rails 2 (and to carry the current further on to an electric motor 7 and optionally other current consumers on the vehicle) as well as to serve as drive wheels to cause the train to be propelled. This takes place in that the motor 7 is mechanically connected with a shaft 6 via a gear wheel transmission 8. As described more fully below, each wheel 5 has an electrically conducting part, and the current is collected from there by means of current collectors 9 and is conveyed through a current conductor 10, 14 to one connection terminal of the motor. The other wheel of the wheel set is correspondingly connected with the other connection terminal 11 of the motor 11.

The current conductors 10, 14 and the current collectors 9 may optionally be combined to a single spring body, which is pressed against the wheel 5 at one end and may have direct contact with the commutator of the motor at the other end, which is a very inexpensive solution.

The mode of operation is as follows: when the battery 3 is connected to the rails *2a*, *2b*, electrical current runs from the positive pole of the battery via the connection lead 15 to one rolling rail *2a* and from there via the electrically conducting part of the wheel, the current collectors 9 and the current conductor 14 to one connection terminal 12 of the motor. The current runs from the other terminal 11 of the motor via the current conductor 10, the current collectors 9, the electrically conducting part of the wheel, the rail *2b* and the connection lead 13 back to the negative pole of the battery. This current makes the motor 7 rotate and thereby the vehicle move on the rails *2a*, *2b*. If the battery is inverted (the positive pole is connected to the rail *2b* and the negative pole to the rail *2a*), the motor 7 rotates in the opposite direction and thereby causes the vehicle to move in the opposite direction on the rails *2a*, *2b*.

FIG. 2 is a perspective view of the components of which a wheel according to the invention is composed. It is a carrying part 20 which is typically made of a plastics material, an electrically conducting part 21 of metal, a spring body 22 comprising the current collectors 9 and a shaft 23.

FIG. 3 shows a vertical section through an assembled wheel according to the invention, and the wheel is shown in perspective in FIG. 4.

The carrying part 20 is made of insulating plastics material and firmly mounted on the shaft 23. The carrying part is formed along its periphery with a groove 24 in which an adherence ring 25 of a material with a high coefficient friction, e.g. a rubber material, is embedded. This ring 25 constitutes the rolling face of the wheel and entails because of its high friction that the vehicle has a high tractive force.

The carrying part 20 is moreover provided with a plurality of holding pins 26 serving to retain and guide the electrically conducting part 21, which is provided with a corresponding number of openings 27. Since each holding pin 26 engages one of the openings 27, the carrying part 26 and the electrically conducting part 21 are locked to each other so that they cannot rotate mutually, but have to rotate about their axis with the same speed of rotation. A projection 28 on the holding pin 26 ensures that the electrically conducting part 21 cannot drop out of the wheel, and it also forms a stop for the movement of the electrically conducting part. The spring body 22, which is provided with two springs/current collectors 9, urges, by means of these, the electrically conducting part 21 to a position where it engages the carrying part 20.

When the electrically conducting part 21 is subjected to a force on the flange 29, e.g. from the rail *2a*, *2b* in FIG. 1, the springs 9 yield, and the electrically conducting part 21 moves in a direction towards the spring body 22, optionally until it hits the projections 28. Thus, the springs 9 are used both for current collection and for providing spring force. Owing to the spring effect, the flange 29, when the wheel rolls on a rail, will constantly be pressed against the rail and thereby ensure good electrical contact with the rail. The spring action simultaneously gives a self-cleaning effect since both the rail and the electrically conducting part 21 of the wheel are kept clean of dirt.

FIGS. 5 and 6 show an alternative embodiment.-This too includes a carrying part 30 and an electrically conducting part 31 as well as a spring body 22 and a shaft 23. Instead of the holding pins 26, the carrying part 30 has a circular flange 32 engaging a corresponding groove 33 on the electrically conducting part 31. This entails that the two parts may rotate about their axis independently of each other, which can improve the self-cleaning effect.

Though it is mentioned in the foregoing embodiments of a wheel according to the invention that the wheel is used for a train rolling on rails, it is noted that the wheel may also be used in other forms of toy vehicles. An example is an electrically driven aerial cableway where one or more electrically conducting cables are used instead of the rails.

It should finally be mentioned that e.g. the spring body 22 may be constructed in many other ways, e.g. as a spring disc applying a uniform pressure all the way around on the electrically conducting part.

We claim:

1. An electrical contacting toy wheel for a model electrical train having wheels which ride along rails of a track and a motor which draws electric current from the track to drive the wheels of said train along said rails, each of said wheels having a rolling face that rides upon a rail and a flange that rolls alongside said rail, said contacting wheel comprising:

a first wheel part having a rolling face, said rolling face having a surface with a sufficiently high coefficient of friction so that in use, said first wheel part rides on said rail and frictionally engages said rail to propel said model electrical train along said track;

a second wheel part formed of an electrically conducting material disposed axially adjacent to said first wheel part on one side of said rolling face, said second wheel part defining said flange which rolls alongside said rail and forming a part of an electrical current path to said motor; and biasing means resiliently urging said second wheel part toward said first wheel part to conductively engage said track.

2. A toy wheel according to claim 1, wherein said wheel first part rolling face surface comprises a rubber ring.

3. A toy wheel according to claim 1 wherein the second wheel part comprises a cone shaped flange extending radially beyond said first wheel part rolling face.

4. A toy wheel according to claim 1 wherein the electrical contacting toy wheel is journalled in a bracket, and said biasing means comprises a spring body provided on the bracket, said spring body being adapted to press the wheel second part resiliently against the wheel first part.

5. A toy wheel according to claim 4, wherein said spring body is incorporated in said electrical current path from the wheel second part to one or more current consumers on the train.

6. A toy wheel according to claim 1, further comprising means for retaining the wheel first and the wheel second part to one another to rotate together.

7. A toy wheel according to claim 6 further comprising holding pins on said wheel first part extending in an axial direction and corresponding openings on the wheel second part positioned to receive said pins whereby said pins secure the wheel second part to said wheel first part while permitting limited axial movability of said wheel second part with respect to the wheel first part.

8. A toy wheel according to claim 1, wherein said wheel first part and wheel second part can independently rotate.

* * * * *